United States Patent [19]

Gonzalez-Lopez

[11] Patent Number: 4,862,154

[45] Date of Patent: Aug. 29, 1989

[54] IMAGE DISPLAY PROCESSOR FOR GRAPHICS WORKSTATION

[75] Inventor: Jorge Gonzalez-Lopez, Red Hook, N.Y.

[73] Assignee: International Business Machines Corporation, Armonok, N.Y.

[21] Appl. No.: 926,310

[22] Filed: Oct. 31, 1986

[51] Int. Cl.[4] ..... G09G 1/16

[52] U.S. Cl. ..... 340/747; 340/799; 340/721

[58] Field of Search ..... 340/750, 721, 747, 703, 340/799, 798, 800, 801, 802

[56] References Cited

U.S. PATENT DOCUMENTS

| | | | |
|---|---|---|---|
| 4,121,283 | 10/1978 | Walker | 340/721 |
| 4,197,590 | 4/1980 | Sokonick et al. | 340/747 |
| 4,298,931 | 11/1981 | Tachuichi et al. | 340/799 |
| 4,496,976 | 1/1985 | Swanson et al. | 340/750 |
| 4,616,220 | 10/1986 | Grunewald | 340/747 |
| 4,679,038 | 7/1987 | Bantz et al. | 340/750 |

*Primary Examiner*—John W. Caldwell, Sr.
*Assistant Examiner*—Alvin Oberley
*Attorney, Agent, or Firm*—George E. Clark; Mark S. Walker

[57] ABSTRACT

The presesnt invention provides for the combining of image and graphics data in a high-performance raster graphics workstation. It allows the definition of windows on the screen, the dynamic control of the position of those windows, the magnification factor (integer zoom), and a color translation table, corresponding to each window. All these functions are under user control. Response time of 10 new frame buffers generated per second provides a "real" time response.

4 Claims, 10 Drawing Sheets

IMAGE DISPLAY PROCESSOR FOR GRAPHICS WORKSTATION

BACKGROUND OF THE INVENTION

1. Field of the Invention

The present invention relates to information handling systems, and more particularly to information handling systems including a graphic workstation having the capability of processing graphics data and image data for display on a single display monitor.

2. Prior Art

The idea of having a copy of the original image in the terminal is not new. The image processor in the IBM-7350 image display and processing terminal uses special purpose memories (called band buffers) to store image data. However, because it has a single frame buffer its "real"time interactive capability is limited to operations on the frame buffer content. These operations are implemented on the video path and consist basically in image zoom, image roam, and VLUT (Video Look-Up Table) manipulation.

The use of double frame buffers is standard in high performance graphics terminals such as the IBM-5085. No interactive image display capability is provided.

None of the prior art known to the inventor hereof teaches the concept of combining image data at sub-video rate into a frame buffer with a word length smaller than the number of bits used in the original image to represent each pixel, and making use of a double buffer to allow the implementation of interactive image display functions as those described.

U.S. Pat. No. 4,484,187 shows a video overlay system having interactive color addressing which includes two refresh buffers, each four bits deep, with outputs to a look-up table, with two additional bits stored in special registers to be combined with the eight bits from the buffers to address the look-up table while operating at video scan rates. The purpose of the patent is to provide a depth effect by moving one image over another. The patent does not show a graphics workstation for displaying image and graphics data including among other things a graphics data processing means and an image data processing means.

U.S. Pat. No. 4,439,760 shows method and apparatus for compiling three-dimensional depth digital image information. The invention deals primarily with the implementation of a depth sorting algorithm on a video bus when data are transferred from a set of video memories to a look-up table. The patent does not teach or suggest a graphics workstation for displaying both image and graphics data which includes among other things a graphics data processing means and an image data processing means.

U.S. Pat. No. 4,200,869 shows a data display control system with plural refresh memories. The invention primarily relates to the display character data. The contents of two frame buffers operating at a video rate and containing character data are conditionally displayed under control of a display control bit in each of the buffers. Image superposition and shifting is achieved via corresponding start address registers in the time control circuit which generates the same buffer addresses.

As with the prior art described above, the patent does not teach a graphics workstation for displaying both image and graphics data which includes among other things a graphics data processing means and an image data processing means.

U.S. Pat. No. 4,447,882 shows method and apparatus for reducing graphics patterns coded by binary characters and represented in rows and columns of a prescribed grid. As with the prior art discussed above, the patent does not teach a graphics workstation where displaying both image and graphics data which includes a graphics data processing means and an image data processing means.

U.S. Pat. No. 4,360,884 relates to apparatus for displaying a plurality of fundamental figures each defined by a preset number of vectors on a display device of the raster scanning type. The patent describes a display device to display polygon shaped figures given the edges end points plus edge gradient information. It employs video line buffers for storage.

The patent does not teach nor suggest a graphics workstation for displaying both image and graphics data including a graphics data processing means and an image data processing means.

U.S. Pat. No. 4,528,634 relates to a bit pattern generator including a mask pattern checking system based on the mask being verified being scanned, comparing the scanned image to the output of a bit pattern generator (a reference image) and detecting any discrepancy between the scanned and the referenced image.

As with the prior art described above, the patent does not teach a graphics workstation for displaying both image and graphics data which includes among other things a graphics data processing means and an image data processing means.

U.S. Pat. No. 4,367,466 describes a display control apparatus for a character oriented display. It used double line buffers in which characters to be displayed are stored in a coded form as opposed to a pixel all points addressable form.

As with the prior art described above, the patent does not teach a graphics workstation for displaying both image and graphics data which includes among other things a graphics data processing means and an image data processing means.

SUMMARY OF THE INVENTION

Therefore, it is a object of the present invention to display image data and graphics data in a graphics display associated with a graphics workstation including system control processing means for controlling workstation functions, storage means for storing image and graphic data, graphics data processing means, image data processing means, a plurality of interleaved frame buffers for storing data to be displayed, and display means for displaying the image data and the graphics data.

It is a further object to display both image data and graphics data in a graphics workstation, as above where the graphics workstation further includes an image data processor including input control means, means for converting input data format to a form suitable for storing in a frame buffer, and address control means for controlling the storing of information into said frame buffer.

It is a further object to display both image and graphics data in a graphics workstation as above which further comprises a plurality of look-up tables for converting said input data to a form acceptable by said frame buffer.

It is a further object to display both image and graphics data in a graphics workstation as above wherein the frame buffer includes a pair of frame buffers which are interleaved such that while one frame buffer is being read out to provide video information to a display means, the other frame buffer is available to be written with new video data for a next incremental image to be displayed.

Accordingly, a graphics workstation for displaying both image and graphics data includes the system control processing for controlling workstation functions, a storage means for storing image data and graphics data, a graphics data processor, an image data processor including means for handling, a number of separate bands of image data wherein each band may be different color information a number of interleaved framed buffers for storing data to be displayed and a display means for displaying the image and graphics data.

The foregoing and other objects, teachings and advantages of the invention will be apparent from the following more particular description of the preferred embodiments of the invention as illustrated in the accompanying drawing.

DETAILED DESCRIPTION OF PREFERRED EMBODIMENT OF THE INVENTION

Introduction

Figure 1:
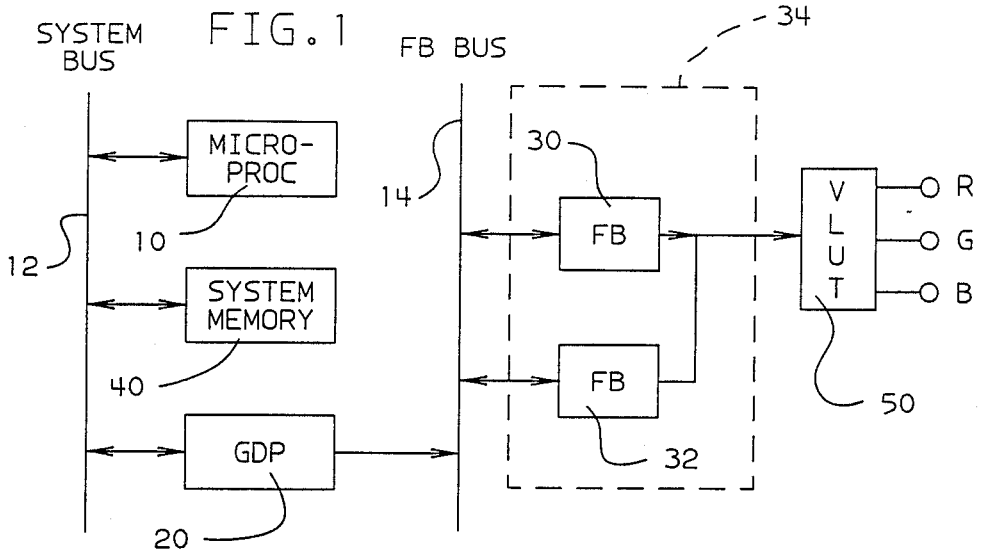
FIG. 1 is a block diagram of a typical graphics workstation for processing graphics data.

State of the art, high performance, graphics workstations consist usually of the following main components (see FIG. 1):

1. A microprocessor system 10 which takes care of I/O (i.e. keyboard, tablet, etc.) and host link, and is responsible for the overall system control.

2. A Graphics Display Processor 20 (GDP) with the mission of model transformation, clipping, and mapping, as well as generation of vectors, characters, pattern, etc. on the screen.

3. Frame buffer (FB) 34 includes two identical buffers 30 and 32 which are alternated as follows. At a given time, the contents of one of them, for example FB 30, is being displayed (through the video look-up table (VLUT) 50 and three digital to analog converters (DAC's) (not shown), while the other for example, FB 32 is available to GDP 20. Once a picture is drawn in the frame buffer 32 available to GDP 20, the buffers are swapped. The just written buffer 32 is displayed and buffer 30 becomes available to GDP 20, starting a new cycle. It is generally accepted that if the just described process is repeated about ten times per second, a satisfactory visual effect is obtained when simulating moving objects.

4. A System Memory 40 in which the program that controls the microprocessor 10 and the graphics orders that defines the graphics model are stored. The graphics orders are interpreted by GDP 20 under microprocessor control.

Figure 2:
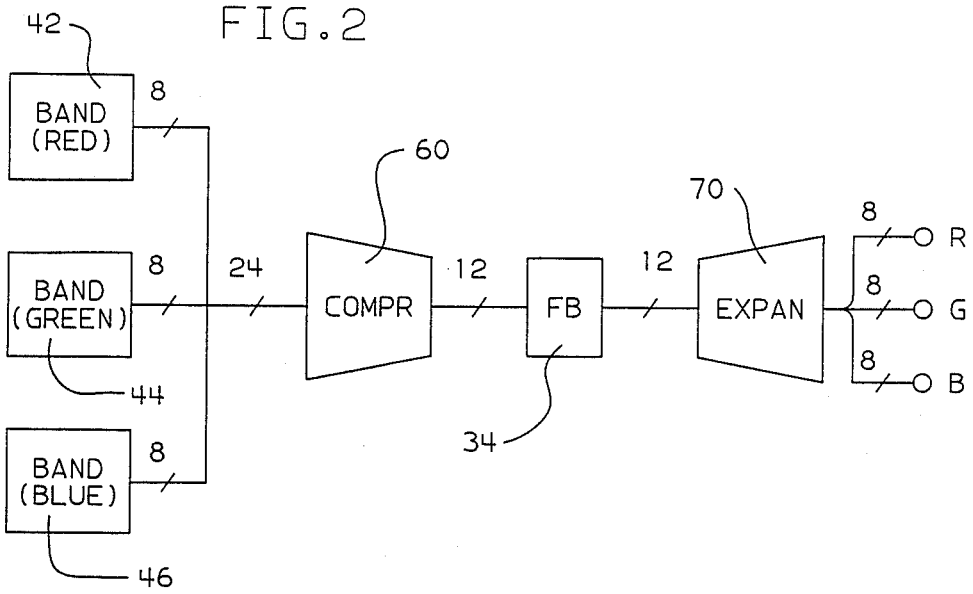
FIG. 2 is a block diagram of a frame buffer with associated data compression and expansion elements which could be used with a first embodiment of the present invention.

Besides performing graphics functions, most graphics workstations allow the display of image data as well. Image data is down loaded from the host system and stored in FB 34. The FB word length is usually limited to 8 or 12 bits. Color images consist usually of three or, more bands, each one being coded as 8 bits per display picture element or pixel (see FIG. 2). (By image it is meant the data obtained by an optical scanner or a TV camera, for example). Most often the bands correspond to the three primary colors (red, green, and blue), but in some cases one or more of them is associated with other physical parameters like temperature, texture, etc. Assuming a three-band image, a total of 24 bits per pixel is required to represent the original image. As the frame buffer is 12 bits per pixel only (let us assume it) it follows that some kind of compression is required to code the 24 bit original data into the 12 bit FB word. The situation is depicted in FIG. 2 in which the box 60 labelled "compr" performs the compression function. Box "expan" 70 in FIG. 2 implements the inverse function (expansion) to get three 8 bit words to drive the DAC's. (It has been assumed 8 bit precision DAC's) The expansion function can be implemented by VLUT 50 in FIG. 1.

The transformation process implicit in FIG. 2 is image dependent. If the result does not look good, the operator may desire to repeat it with a new set of parameter values. A new FB content must be computed at a host (not shown) and sent to the workstation. This operation usually takes a few seconds.

Windowing

If "real" time response is to be provided, the most practical approach is to store a copy of the original image in the workstation and do the transformation process locally avoiding the transfer of data from the host. A speed of about 10 pictures per second would allow the operator to feel a pseudo real time response when controlling the appearance of the image being displayed.

If two or more images are displayed in corresponding windows defined on the screen, a transformation function must be provided for each window. Strictly speaking, both the compression and expansion functions are image dependent and they both should be matched to the statistics of the image being displayed if the goal is to make minimal the loss of information. For practical purpose the expansion box 70 (which is expensive to implement because it must operation at video rate) must be kept the same for all windows on the screen. The compression function 60, however, can be made different for each window by changing the parameters that defines it.

Figure 7:
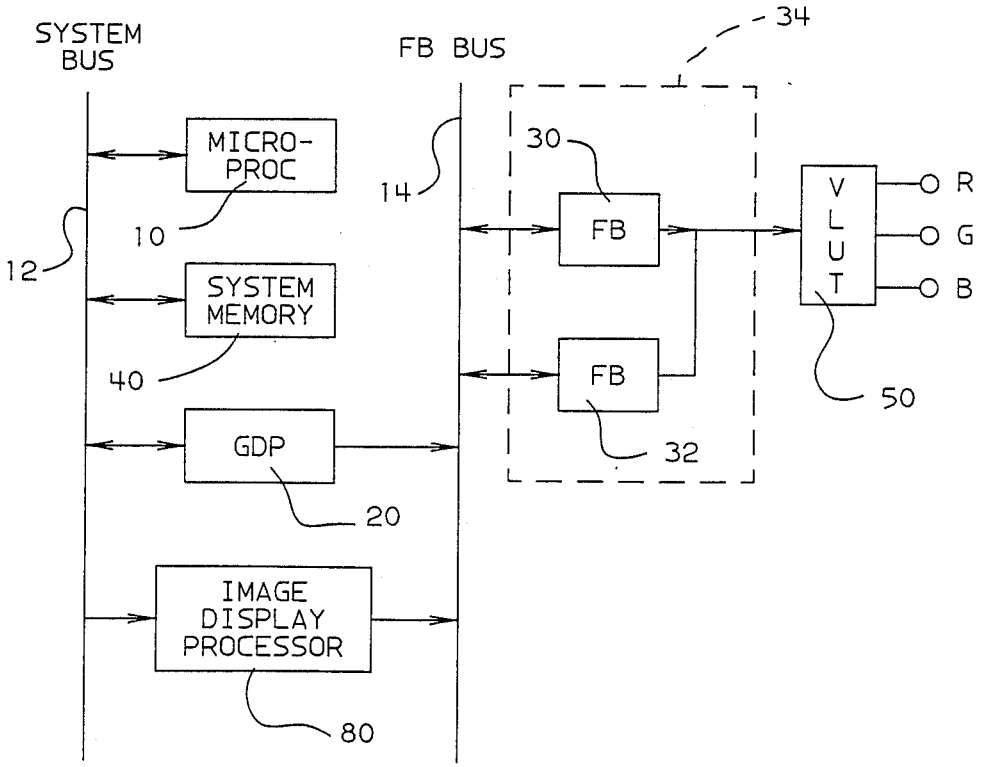
FIG. 7 is a block diagram of a graphics workstation according to the present invention including an image display processor.

This invention makes use of the double frame buffer existing in graphics workstations to provide the mentioned transformation function to each one of the different windows defined on the screen. The additional required hardware is represented by box "Image Display Processor" (IDP) 80 in FIG. 7. Graphics can be added to the displayed image by GDP 20 in the usual way.

IDP 80 allows the definition of multiple windows on the screen with independent control of the color translation function that applies to each window, the dynamic modification of the window position on the screen and the image position in the window, the zoom factor applied to each window (integer zoom by pixel replication), the sequential display of multiple images to achieve animation, etc. to mention just a few examples.

For the purposes of the present invention,

System memory word is 32 bits wide.

An image consists of one or more bands (typically three for a color image) each one being coded in 8 bits per pixel. Bands are stored in system memory row-wise, line after line. Data belonging to a band are kept together. No band interleave is implemented.

4. The number of pixels in a row of the image is a multiple of four. Row data is padded with dummy pixels if required.

5. Frame Buffer size is 1024×1024.

6. Frame Buffer word is 12 bits wide.

7. System memory bus 12 supports 40M bytes/sec sequential data transfer rate from system memory 40 to Image Display Processor (IDP) 80.

8. Frame Buffer 34 writing speed is 13.3M pixels/sec from FB bus 14.

Image Display Processor

Figure 8:
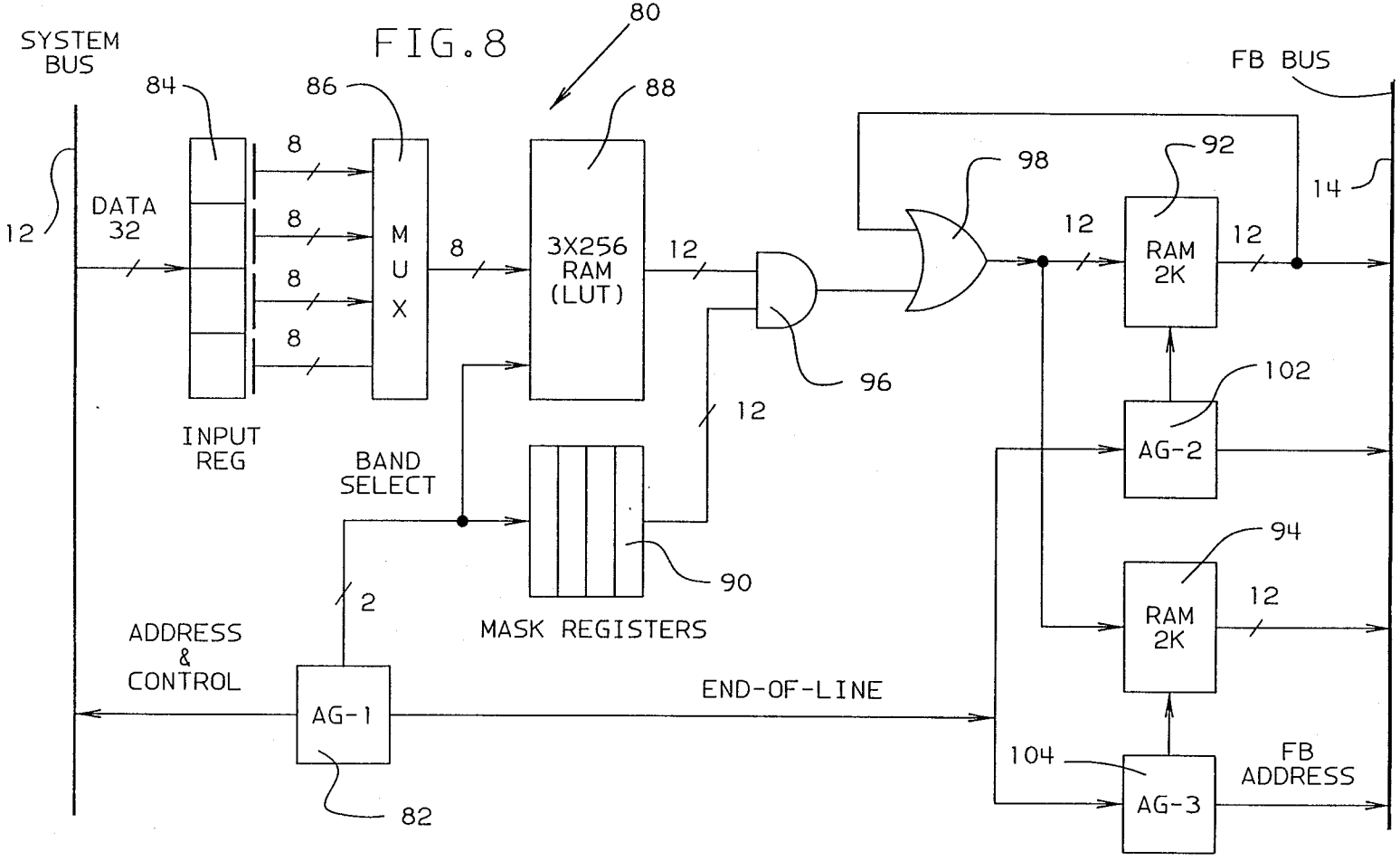
FIG. 8 is a block diagram of an image display processor as shown in FIG. 7.

The IDP 80 consists of (see FIG. 8):

1. Address Generator (AG1) 82 which provides addresses and control signals to system memory 40 through System Bus 12. AG1 provides input control to the Image Display Processor 80. Data from memory 40 is sent through the bus 12 and is latched into input register 84. The transfer takes place in fast, sequential mode.

2. An input register 84 which latches 32-bit (4 pixels) data from system memory 40.

3. A multiplexer 86 that selects, in sequence, each one of the four pixels latched in the input register 84.

4. A bank of look-up tables (LUT) 88 of 256×12 bits each.

5. Mask registers 90, each one being 12 bits wide.

6. Two output buffers 92, 94 (about 2048×12 bits each) in a double buffer configuration. At a given time, one of the buffers is associated to the frame-buffer bus (FB bus) 14 while the other is being written with data from the LUT 88 through the "and-or" logic 96, 98. The buffer 92, 94 being written implements a read-modify-write cycle. The "modify" part is an "or"operation.

7. An Address Generator (AG2) 102 associated with the output buffer (for example 92) being written.

8. An Address Generator (AG3) 104 associated with the buffer (for example 94) that places data into FB bus 14. AG3 provides FB storage control through parameters that specify window size and location and relocation factors. This address generator allows the replication of pixels and the replication of lines (rows) of the image being transferred to FB 30, 32, and, therefore, the implementation of zoom by integral factors. Independent zoom control is provided for X and Y coordinates. FB 30, 32 is always written row-wise, one line after the other.

Operation

Figure 9:
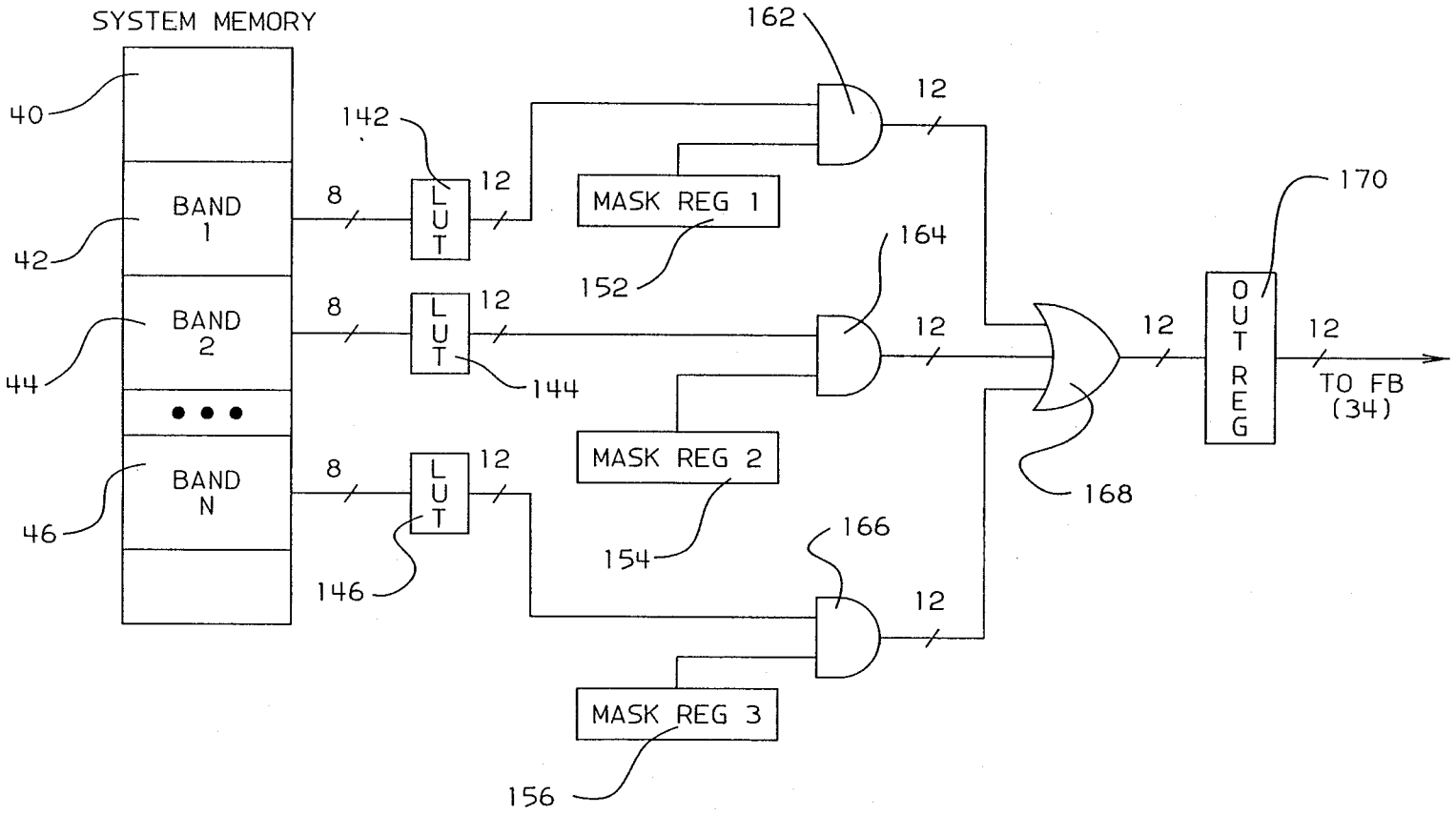
FIG. 9 is a logical block diagram showing the combination of data from a number of bands of data into a form for storing in the frame buffer in accordance with the present invention.

The logical data flow of the described hardware is given in FIG. 9. Conceptually, data from (up to) three selected bands 42, 44, 46 in system memory 40 are combined, in a pixel-by-pixel basis, to form 12 bit words, one for each pixel. Each word is stored later in the appropriate frame buffer 30, 32. A different primary color is usually associated with each selected band.

Data from the bands are first transformed by LUT's 142, 144, 146 (one table per band being combined) and their outputs are combined under control of three mask registers 152, 154, 156. The mask register contents control which FB word bits are taken from each LUT output through AND gates 162, 164, 166 respectively.

The following example shows the resultant FB word bit assignment for some given contents of the mask registers.

| | | | | |
|---|---|---|---|---|
| R: | 1110 | 0000 | 0000 | Content of mask register 1 |
| G: | 0001 | 1111 | 0000 | Content of mask register 2 |
| B: | 0000 | 0000 | 1111 | Content of mask register 3 |
| | RRRG GGGG BBBB | | | Frame Buffer word |

In the example given above, each FB word contains 3 bits from band A (red) LUT output, 5 bits from band B (green) LUT output, and 4 bits from band C (blue) LUT output.

Referring to FIG. 9, data from the first row of band A 42 is table transformed first in LUT 142, then "anded" in AND 162 with the content of mask register 1, 152, and finally the result is placed in one of the two output buffers 170 which is used as a temporary storage. The "or"operation 168 is inhibited for data of band A. At the end of the process just described, the output buffer 170 contains masked, transformed data from the first line of band A.

The first line of band B 44 is then processed in a similar way through LUT 2 144 and mask register 2, 154. The data previously stored in output register 170 is "ored" with the new data corresponding to band 2 during the "modify"part of the "read-modify-write" cycle. The first line of band C is then processed similarly.

When the first line has been processed, the output buffers are swapped. The result is transferred to FB 30, 32 through the FB bus 14. Pixel and line replication may take other output buffer is now ready to accept the new data corresponding to line 2 in a similar way to the one just explained.

Address generator parameters

Address Generator - 1

AG-1 82 is loaded with a set of parameters that define the location in system memory 40 of the image data to be transferred to a selected window on the screen. The data transfer operation does not modify the parameter values by itself. After completion of the transfer operation corresponding to the whole window, the microprocessor 10 is notified via interrupt. The microprocessor 10 can then modify any parameter with the appropriate value. The parameters are the following:

1. System Memory start location address, Band-A.
2. Address increment to start new row, Band-A.
3. System Memory start location address, Band-B.
4. Address increment to start new row, Band-B.
5. System Memory start location address, Band-C.
6. Address increment to start new row, Band-C.
7. Number of words corresponding to one row (see note below).
8. Number of rows in image corresponding to screen window.
9. Number of bands involved in the operation.

NOTE: Number of words in a row may differ from band to hand due to possible misalignment between bands. This parameter should be set to the highest value of them.

Address Generator-2 102

The parameter involved are the following:

1. Start buffer location address, Band-A.
2. Start buffer location address, Band-B.
3. Start buffer location address, Band-C. End of line information is provided by AG-1

Address Generator-3 104

The parameters involved are the following:

1. Initial X coordinate of window.
2. Initial Y coordinate of window.
3. Window X dimension.
4. Window Y dimension.
5. Writing direction for x-coordinate (positive or negative).
6. Writing direction for Y-coordinate (positive or negative).
7. X Replication factor.
8. Y Replication factor.
9. X Replication factor for first column.
10. Y Replication factor for first row.
11. Buffer start location address.

NOTE: The replication factor for first row and for first column are intended to allow a smooth image pan in zoom mode.

Combination of misaligned data

Figure 10:
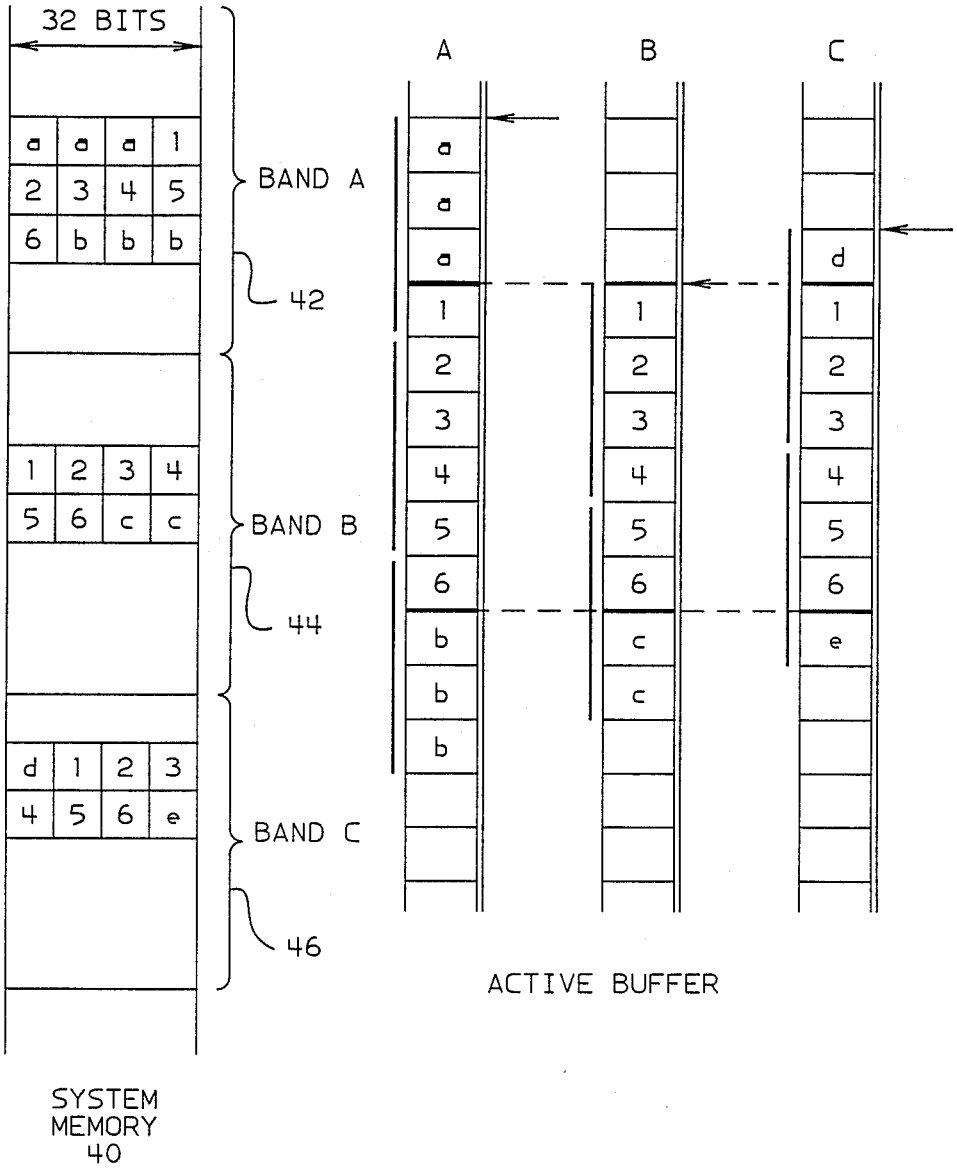
FIG. 10 is a schematic diagram showing how misaligned data contained in system memory may be properly aligned for combination in the frame buffer in accordance with the present invention.

Image data in system memory 40 to be combined by IDP 80 may be misaligned, i.e. elements corresponding to the same pixel of the bands being combined are not necessarily stored in the same byte position within word boundaries. The situation is illustrated in the left part of FIG. 10. Pixel 1 of band A 42 is stored in the least significant position, and the one of band C 46 is in the second most significant position. The right portion of FIG. 10 shows the relative position of the combined data from the three LUT 142, 144, 146 outputs in the output buffer 170. Note that each row in the figure corresponds to one output buffer location and that each location is filled with data corresponding to the same pixel. This is obtained by setting the AG-2 102 parameters with the appropriate values. In the figure small letter a, b, c, d, and e represent data in system memory 40 that is irrelevant for the purpose of this explanation. They are processed but not transferred to FB 30, 32.

Figure 11:
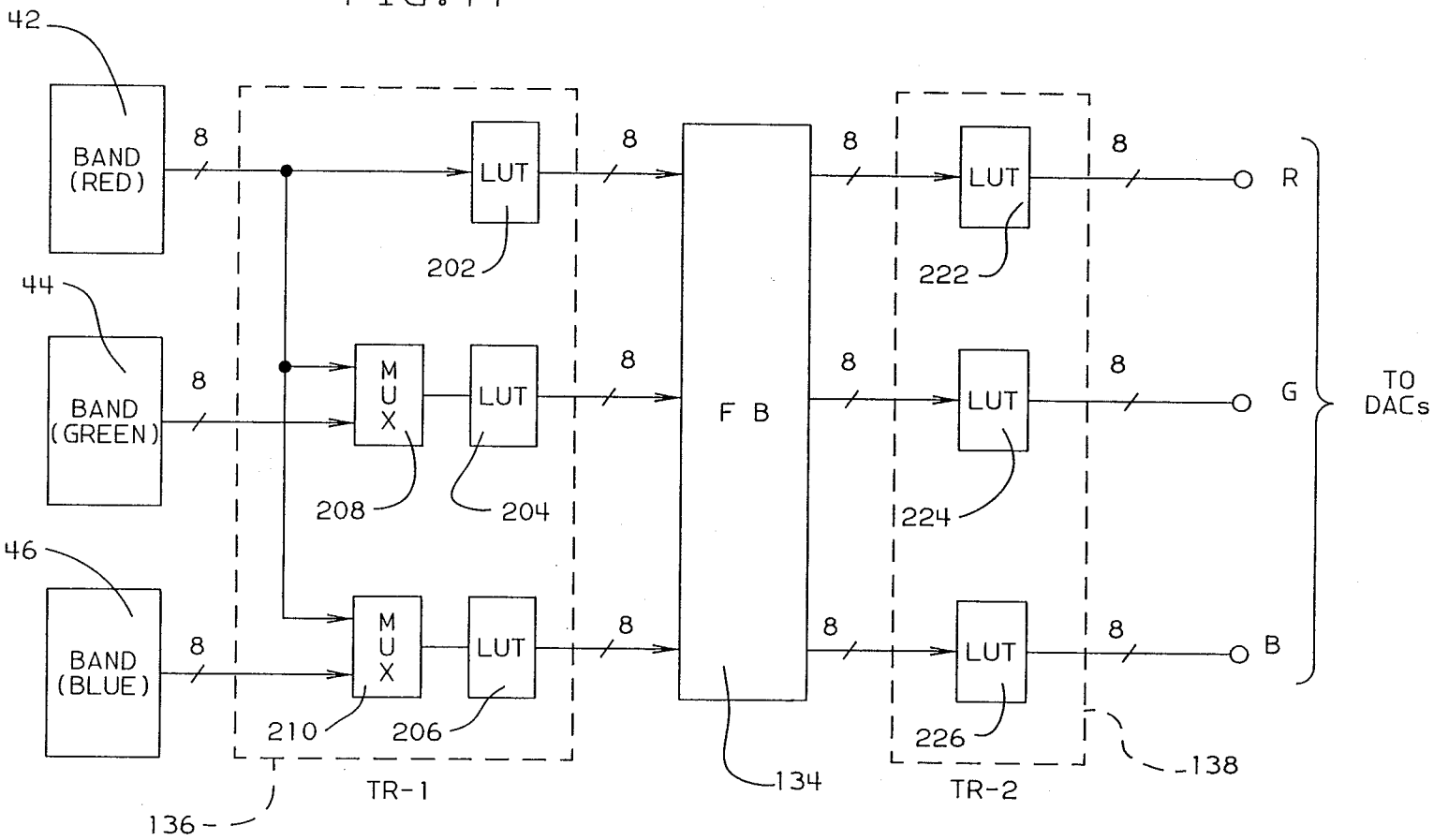
FIG. 11 is a block diagram showing the transformation without compression of bands of image data to a form which may be stored in the frame buffer in accordance with a second embodiment of the present invention.

Referring now to FIG. 11, an alternate embodiment of the present invention will be described.

If the frame buffer 134 has a data path 24 bits wide (8 bits wide per primary) there is no need to compress image information from 24 bits to 12 bits as was done by compressor 60 as shown in FIG. 2 and described above.

However, it is convenient to include pretransform function TR-1 136 and posttransform function TR-2 138 to operate on image data from bands 42, 44, and 46 respectfully. Lookup table 202, 204 and 206 in transfer function 136 may be used to modify brightness and contrast of each primary color. A different look-up table content can be computed for each of a number of windows defined in frame buffer 134. When an input image is monoband (a single primary color) multiplexer 208 and 210 in pretransform function 136 allow data from the single band to drive the three look-up tables 202, 204, and 206 simultaneously. Therefore, pretransformer 136 acts as a single 8 bit in, 24 bit out look-up table. This allows assignment of an arbitrary color value to each pixel value of an input image.

The post transform function TR-2 138 includes three 8 bit in, 8 bit out look-up tables 222, 224, and 226 respectively. These look-up tables are the common video look-up tables normally used in graphics terminals between a video pixel frame buffer and the digital to analog display drive circuits. An application program might load these look-up tables 222, 224, and 226 with a function (for example, a gamma correction function to compensate for possible monitor non-linearity) that applies to all possible windows to be defined on the display screen.

Figure 12:
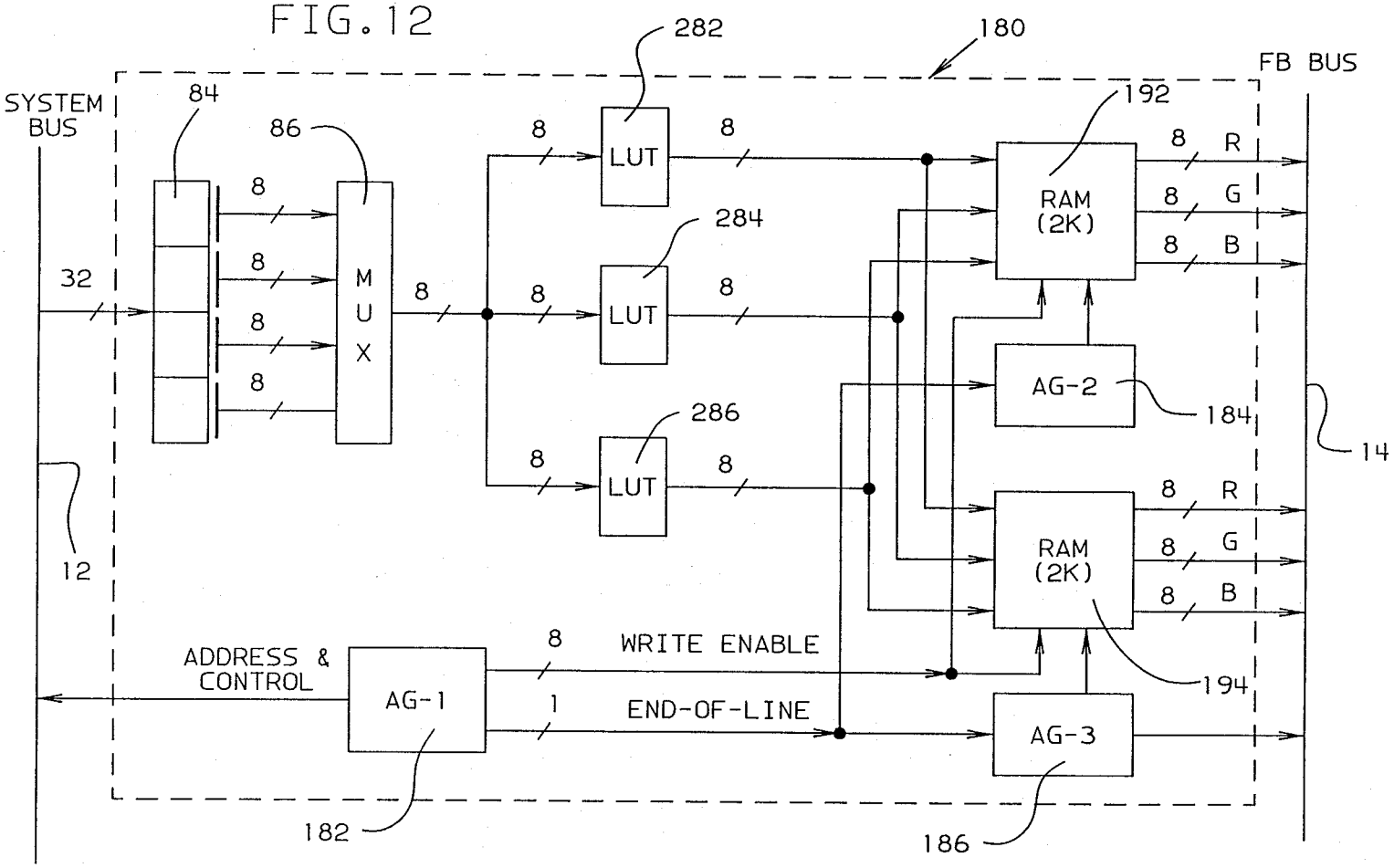
FIG. 12 is a block diagram of an image display processor in accordance with a second embodiment of the present invention.

Referring now to FIG. 12, an image display processor 180 for use with a frame buffer 134 having a 24 bit wide data path will be described.

As was described earlier with reference to FIG. 8, data is input from system bus 12 to input register 84 four pixels at a time wherein each pixel contains 8 bits such that input register 84 must be 32 bits wide. Multiplexor 86 selects in sequence one of the 4 pixels latched in input register 84 for presentation to look-up tables 282, 284, and 286. Each of the look-up tables is 256 words of 8 bits each.

Since the frame buffers have the capability to handle a 24 bit wide data path, mask registers and associated logic are no longer required in this alternate embodiment. The 8 bit wide data outputs from look-up tables 282, 284 and 286 respectively are fed to output buffers 192 and 194 which operate in a double buffer configuration as before such that while one buffer is transmitting data to frame buffer bus 14, the other buffer is receiving data from the look-up tables. Address generators 182, 184 and 186 operate in substantially the same manor as address generators 82, 102 and 104 respectively and perform the same functions.

The difference between the primary embodiment and the secondary embodiment is in the simplification of the logic of the image display processor 180 over image display processor 80 due to the 24 bit wide data path which eliminates the need for masking.

Image Data Organization

The following description sets forth the organization of image data in system memory.

Figure 3:
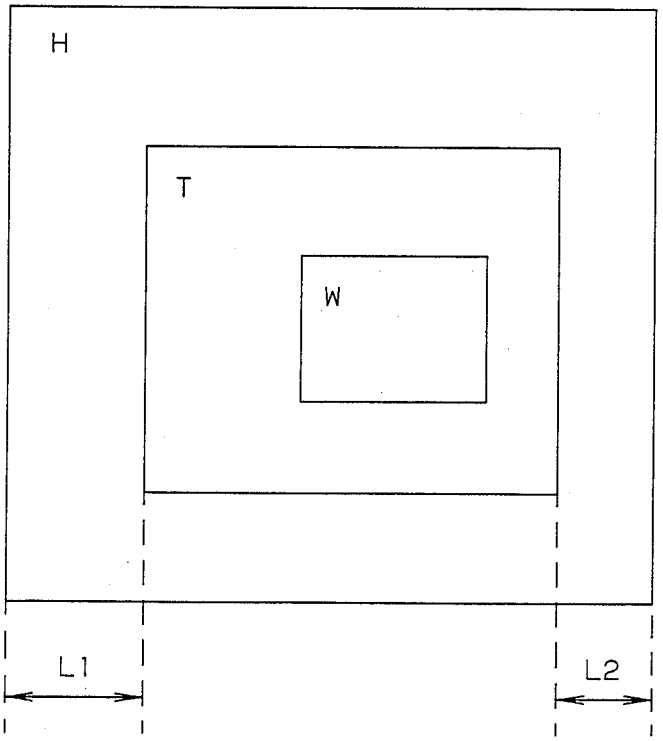
FIG. 3 is a schematic diagram which shows a three level storage system in accordance with the present invention.
Figure 4:
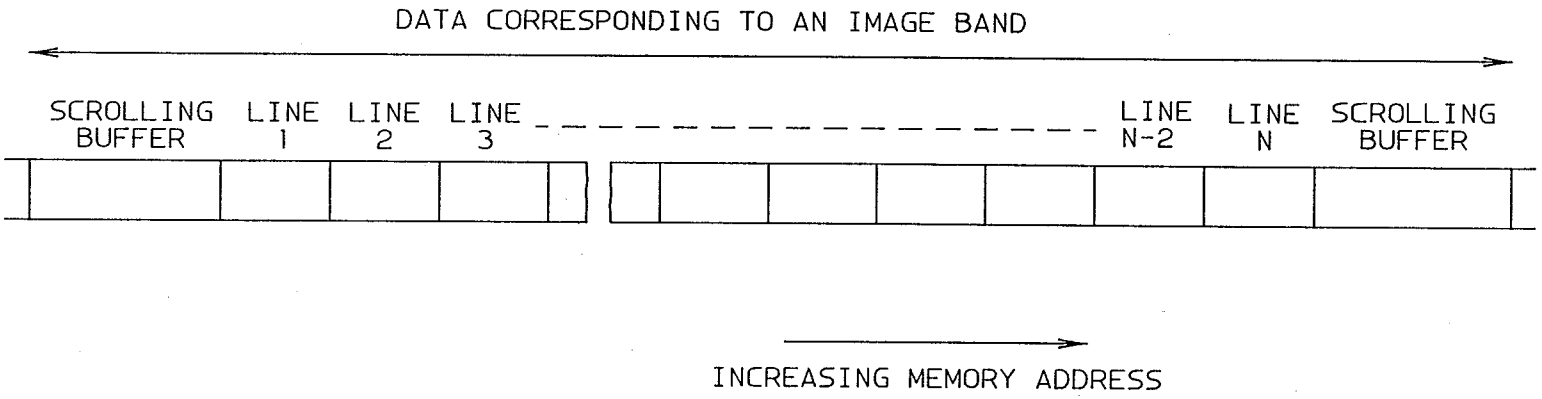
FIG. 4 is a schematic diagram showing the storage structure for lines of image data in accordance with the present invention.

The original image data is stored in a host system for example on a disk. A complete image or a subset is transferred to the workstation and stored in system memory 40. This image or subset is used by the image display processor 80 to generate data to be stored in a window defined in frame buffer 30, 32. This three level storage technique is shown in FIG. 3. In the figure, H T and W represents respectively the image at the host, the subimage edge at the workstation (in system memory) and the subimage on the screen window (in frame buffer) respectively.

The position of T in H can be defined at load time when the image is transferred from the host to the workstation. It is a requirement that the capability of exist to subsequently scroll T within H without the need to retransmit a complete image T.

The position of W in T is handled by a system microprocessor 10 and image display processor 80 as described above.

Operation

For each image band an area in system memory 40 is reserved, having a size large enough to accommodate two image data two "scrolling buffers" as shown in FIG. 10. The buffers must be large enough to store L1 and L2 pixels respectively (see FIG. 3). L1 is the length in number of pixels between a left-hand of the host stored image H and the left edge of the workstation stored image T and L2 is the length and number of pixels between a right-hand edge of subimage T and the host image H left-hand edge.

Horizontal Scroll

Figure 5:
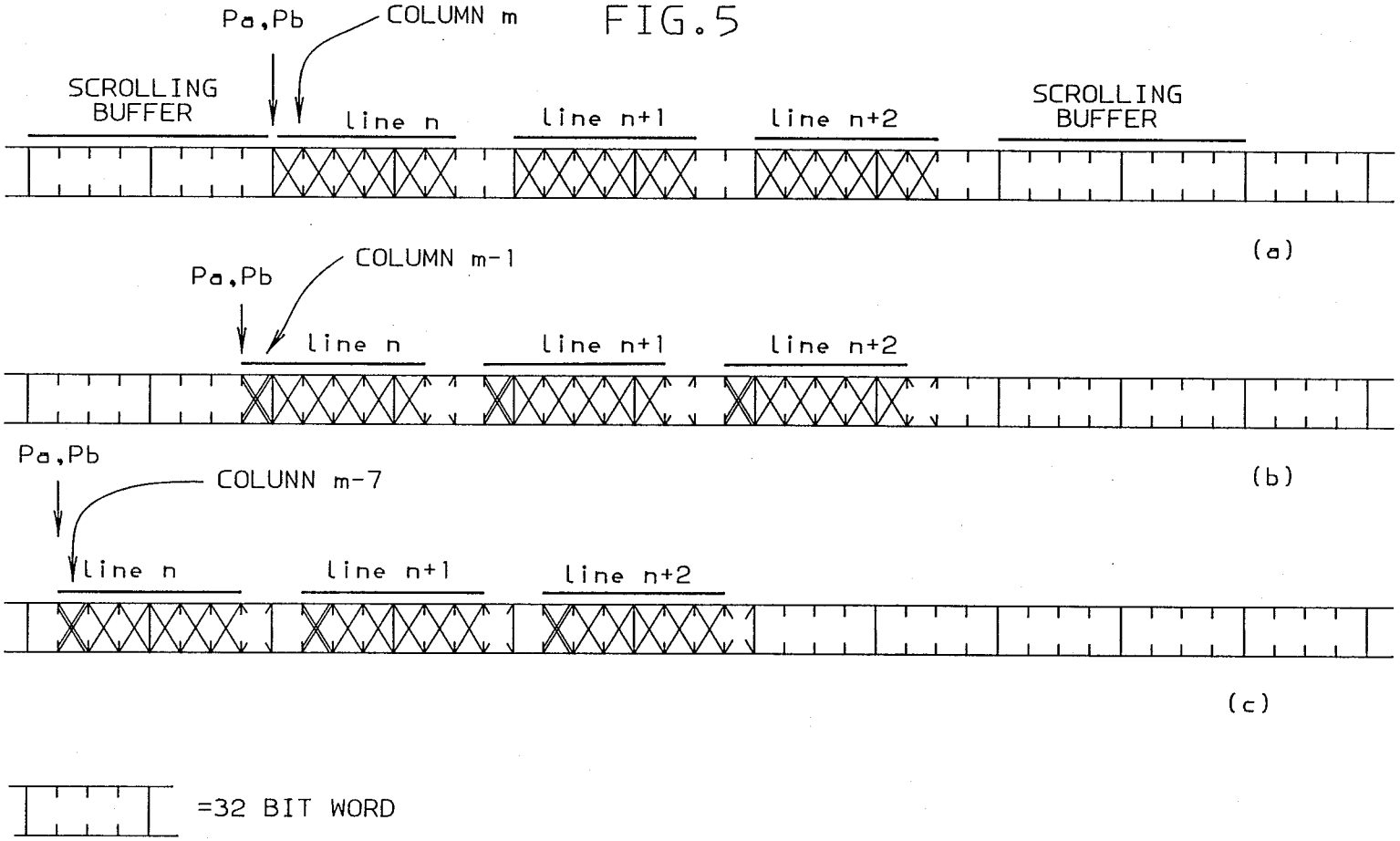
FIG. 5 is a schematic diagram showing how lines of data are handled in a horizontal scrolling operation.

Assuming that the top left pixel of image T corresponds to pixel (line equals n, column equals m) of image H, and that the size of T is $6\times3$ pixels, system memory 40 is loaded with data as shown in FIG. 5(*a*). If T is scrolled left by one column, the data corresponding to column m-1 must be transferred from the host and stored in appropriate system memory 40 locations as shown in FIG. 5*b*.

FIG. 5(*c*) depicts the contents of system memory 40 after a scroll by seven pixels to the left.

Vertical Scroll

Figure 6:
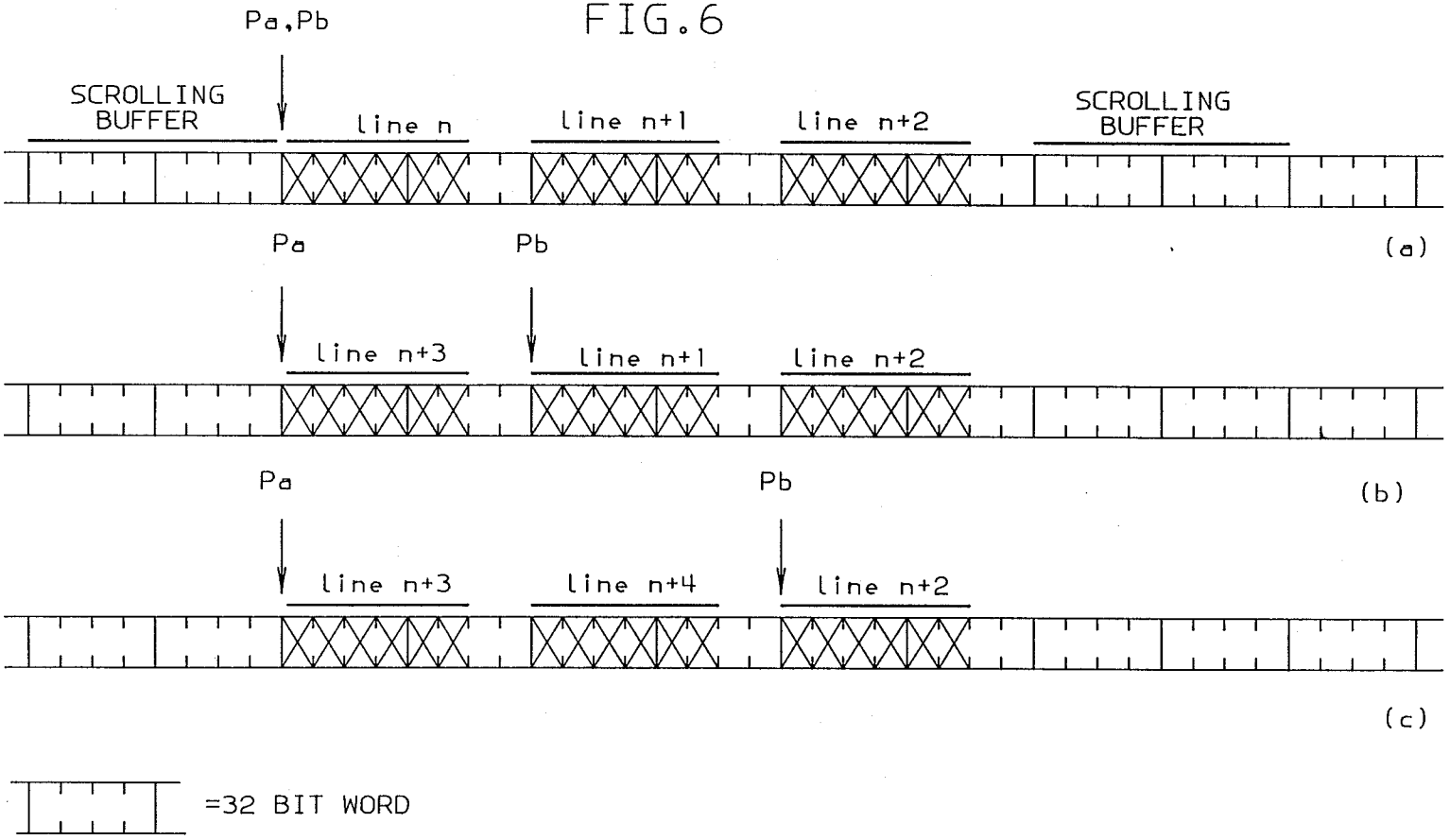
FIG. 6 is a schematic diagram showing memory organization for a vertical scrolling operation in accordance with the present invention.

FIG. 6(*a*) shows the same situation as does FIG. 5(*a*). FIGS. 6(*b*) and 6(*c*) show data in system memory 40 after a vertical scroll in the down direction of 1 and 2 rows respectively.

System microprocessor 10 maintains 2 pointers $P_a$ and $P_b$ (in addition to other possible parameters). $P_a$ points to the beginning of the image data within system memory 40 area corresponding to a given band. $P_b$ points to the initial point of image T.

Note that the image data in system memory corresponding to image W is contiguous or broken into two sections depending upon the relative position of T in H, and the content of $P_b$. It follows that one or two operations are required by image display processor 80, 180 to generate image W.

What is claimed is:

1. A graphics workstation for displaying both image data and graphics data comprising:

first and second buses, said first bus communicating said image data and said graphics data and control information between elements of said graphics workstation and an external processing system, and said second bus communicating processed graphics data and processed image data between processing elements of said graphics workstation and one or more frame buffers;

system control processing means connected to said first bus for controlling workstation functions;

storage means connected to said first bus for storing image data and graphics data;

graphics data processing means connected between said first bus and said second bus for generating graphics images to be displayed from graphics data;

image data processing means connected between said first bus and said second bus for controlling the display of image data on a display;

a plurality of interleaved frame buffers connected between said second bus and a display means for storing said graphics images, said image data, or a composite of said graphics images and said image data to be displayed, said plurality of interleaved frame buffers excepting said graphics images and said image data at a first rate; and display means for displaying image and graphics data at a second rate greater than said first rate.

2. A graphics workstation for displaying both image data and graphics data according to claim 1, wherein said image data processing means comprises:

input control means for controlling the transfer of input data into said image display processing means;

means for converting said input data into a form suitable for storing in a frame buffer; and storage control means for controlling the storing of said converted input data into said frame buffer.

3. A graphics workstation for displaying both image data and graphics data according to claim 2 wherein said means for converting said input data into a form suitable for storing in a frame buffer comprises a plurality of look-up tables.

4. A graphics workstation for displaying both image data and graphics data according to claim 1, wherein said plurality of interlaved frame buffers comprises a pair of frame buffers which are interleaved such that while one frame buffer is being read out to provide video information to said display means the other frame buffer is available to be written with graphics and image data from said graphics data processing means and said image data processing means.

* * * * *